US006520713B2

(12) United States Patent
Sondrup

(10) Patent No.: US 6,520,713 B2
(45) Date of Patent: Feb. 18, 2003

(54) HEIGHT AND ANGLE ADJUSTABLE UTILITY ACCESS DEVICE AND METHOD

(75) Inventor: Chris Sondrup, Lindon, UT (US)

(73) Assignee: Precision Cover Systems, Inc., Lindon, UT (US)

( * ) Notice: Subject to any disclaimer, the term of this patent is extended or adjusted under 35 U.S.C. 154(b) by 0 days.

(21) Appl. No.: 09/815,411

(22) Filed: Mar. 22, 2001

(65) Prior Publication Data

US 2002/0136605 A1 Sep. 26, 2002

(51) Int. Cl.[7] ..... E02D 29/14
(52) U.S. Cl. ..... 404/26
(58) Field of Search ..... 404/26

(56) References Cited

U.S. PATENT DOCUMENTS

| | | | | | |
|---|---|---|---|---|---|
| 275,785 | A | * | 4/1883 | Omensetter | 404/26 |
| 599,441 | A | * | 2/1898 | Dorr | 404/26 |
| 638,692 | A | * | 12/1899 | Banwell | 404/26 |
| 689,224 | A | * | 12/1901 | Pillsbury | 404/26 |
| 814,013 | A | * | 3/1906 | Baumann | 404/26 |
| 1,165,044 | A | * | 12/1915 | Tyler | 404/26 |
| 1,257,324 | A | * | 2/1918 | Daniels | 404/26 |
| 1,447,256 | A | * | 3/1923 | Lincoln | 404/26 |
| 1,639,495 | A | * | 8/1927 | Frame | 404/26 |
| 3,611,889 | A | * | 10/1971 | Levinson | 404/26 |
| 4,174,183 | A | * | 11/1979 | Ferns | 404/26 |
| 4,197,031 | A | * | 4/1980 | Hild | 404/26 |
| 4,273,467 | A | | 6/1981 | Cronk | |
| 4,337,005 | A | | 6/1982 | LeBaron | |
| 4,906,128 | A | * | 3/1990 | Trudel | 404/26 |
| 4,969,770 | A | * | 11/1990 | Bowman | 404/26 |
| 5,051,022 | A | * | 9/1991 | Bowman | 404/26 |
| 5,211,504 | A | * | 5/1993 | Trudel | 404/26 |
| 5,360,131 | A | * | 11/1994 | Phillipps et al. | 220/8 |
| 5,366,317 | A | | 11/1994 | Solimar | |
| 5,451,119 | A | | 9/1995 | Hondulas | |
| 5,470,172 | A | | 11/1995 | Wiedrich | |
| 5,496,128 | A | | 3/1996 | Odill | |
| 5,513,926 | A | * | 5/1996 | Prescott | 404/26 |
| 5,564,855 | A | | 10/1996 | Anderson | |
| 5,813,797 | A | * | 9/1998 | Pendleton et al. | 141/86 |
| 5,956,905 | A | | 9/1999 | Wiedrich | |

* cited by examiner

*Primary Examiner*—Gary S. Hartmann
(74) *Attorney, Agent, or Firm*—Thorpe North & Western

(57) ABSTRACT

The present invention relates to a device and method for adjusting a height and an angle of a cover for a utility access, such as a manhole, to allow a top of the cover to sit flush with the surrounding surface, such as a road. The device has a cover which covers access to the utility; a frame coupled over the utility; an adjuster, coupled between the cover and the frame, for adjusting the height and angular orientation of the cover relative to the frame. The adjuster can include an adaptor ring on the frame, and an extension ring on the adaptor ring. The extension ring can have tabs which selectively engage a plurality of steps on the adaptor ring. The adaptor ring and frame can have mating, angled edges with rotatably engage to adjust the angular orientation as the adaptor ring is rotated with respect to the frame. The angular orientation of the cover can be adjusted by rotating the angled edges, or the adaptor ring and frame, with respect to one another. In addition, the height or elevation of the cover can be adjusted by rotating the tab with respect to the steps, or the extension ring with respect to the adaptor ring.

16 Claims, 4 Drawing Sheets

HEIGHT AND ANGLE ADJUSTABLE UTILITY ACCESS DEVICE AND METHOD

RELATED APPLICATIONS

The present application is related to U.S. patent application Ser. No. 09/653,714, filed Sep. 1, 2000, entitled "Adjustable Manhole Apparatus", and U.S. patent application Ser. No. 09/814,627, filed Mar. 22, 2001, entitled "Adjustable Height Utility Access Device",both invented by Chris Sondrup.

THE FIELD OF THE INVENTION

The present invention relates generally to a utility access, such as a manhole. More particularly the present invention relates to a height and angle adjustable utility access or manhole having a variable cover height adjustment, and variable angular adjustment, to allow the top of the cover to sit flush with the surrounding surface, such as a road.

BACKGROUND OF THE INVENTION

A manhole is an opening in any surface large enough to allow workmen to descend beneath the surface to obtain access to stored materials or equipment or underground installations. The openings are normally in areas carrying traffic so that a means of securely framing and covering the opening must be provided. The manholes must also be strong enough to withstand various external loadings, for example the loading of vehicles moving over the manhole.

In the prior art, the standard procedure has been to frame the opening with a grey iron casting. For example, D&L Supply, of 880 West 150 North, in Lindon, Utah 84042, sells various styles of manhole assemblies. These castings typically incorporate a flanged surface that rests on a supporting structure that is located under ground. This supporting structure typically comprises standard concrete rings long enough so that a number of them form a passage to reach the underground installation. The flanged surface of the manhole transmits the weight of the equipment, together with live surface loads, to the supporting structure. The frame typically incorporates a projecting ledge around the circumference and a cast iron cover rests on the ledge and closes the manhole. The cover is a removable casting designed to carry the surface loads, and must transmit those forces to the underground supporting structure through the frame. The cover must be heavy to avoid vandalism. In some cases it is bolted down in order to make the installation water tight and tamper proof.

In one situation, a subsequent layer of surfacing material (for example, asphalt) is added to the road surface. When this happens, the manhole may need to be adjusted to match the height of the new road. Typically, adjustment is done by filling the space between the manhole top structure and the supporting manhole frame structure with layers of bricks and mortar. This is a manual, time-consuming procedure. In addition, spacers may be used.

Examples of patents related to the present invention, each of which are herein incorporated by reference for their supporting teachings, are as follows:

One patent which illustrates an adjustable manhole is U.S. Pat. No. 4,273,467 to Cronk. The device designed by Cronk is an adjustable manhole cover support. The support comprises an outer ring having a circular internal opening. Threaded members are disposed about the interior of the circular opening. An insert is dimensioned to fit within the outer ring to a depth controlled by the abutment of the insert against the threaded members. Studs engaged and extend through the threaded members to abut the under surface of the insert to provide control of the depth of the insert into the outer ring and the angulation of the outer ring. The support is simple to make, easy to adjust and trouble-free in operation.

U.S. Pat. No. 5,496,128, is an internal fastening band for an internal manhole chimney seal, as well as a means for expanding the band and a means for removing the band. One end of the band is narrower than the other end so that when overlapped the ends of the band nest into one another to form a continuous expansion band. The first end portion has a plurality of apertures longitudinally spaced along the fastening band, and a plurality of slots spaced between the apertures and an end of the fastening band. The second end portion also has an aperture along a tab for engaging one of the slots to connect the first end portion to the second end portion with the particular slot being selected to adjust the continuous circular fastening band to a desired diameter. A tool is described for engaging an aperture in each end portion to increase the diameter of the circular expansion band and force the resilient sleeve against the inside surface of the manhole. An attachment for this tool enabling the removal of this band is also disclosed.

A further related U.S. Pat. No. is 5,564,855, which discloses a stackable height adjustment ring for supporting a manhole cover frame upon a concrete manhole shaft liner that has a ring body that is formed from plastic resin. The ring includes inner and outer radially spaced apart side walls, and optionally, a top wall. Brace arms that are integral with the walls preferably extend radially between the walls for holding them together. The rings have alignment members, e.g., an inner wall of tiering may have an upwardly facing shoulder upon its upper edge and the outer wall, a downwardly facing shoulder on its lower edge. An upwardly extending cylindrical collar at the top of the outer ring fits the downwardly facing shoulder of an adjacent ring. There is also a downwardly extending collar at the lower end of the inner ring to fit on the upwardly facing shoulder of a similar inner ring. The alignment members enable each ring to be held in alignment upon each successive ring beneath it so that the rings can be stacked one upon another to adjust the elevation of the manhole cover frame above a concrete manhole shaft liner. Optionally, the rings have engageable ramps for adjusting the pitch of an upper one of two stacked rings.

A similar U.S. Pat. No. 5,956,905, is a molded plastic extension member for use in increasing the height of manholes, or catch basins when surfacing or resurfacing a roadway. The extension member may be formed having a sloping upper planar support surface to thereby adjust the angle of the catch basin support frame or the manhole cover support frame. An outer surface of the extension member includes indicia that allows the user to align the slope of the upper planer support frame. An outer surface of the extension member includes indicia that allows the user to align the slope of the upper planar support surface parallel with the roadway surface. When several sloped extension members are stacked, the indicia may be used to create a complex angle of slope relative to the underlying base members vertical axis. The extension member includes a pocket adaptable for receiving and retaining mortar between two stacked extensions. Planar surfaces may extend from both the upper and lower edge of the extension member, thereby providing support and added stacking surface for the stacked extension members. The extension member also includes a tapered shoulder that interlocks with either the manhole cone, the catch-basin cone, or with other stackable angled plastic members.

Yet a further prior art U.S. Pat. No. 4,337,005, is concerned with an apparatus for enabling extension or other leveling adjustment of manhole cover supporting structures and the like comprising extension spacer rings resiliently compressed in self-storing fashion adjacent a support sleeve portion of the supporting structure, and adapted to be faced downward from storage to expand into position below the sleeve to extend or adjust the level of the same.

Another manhole cover U.S. Pat. No. 5,366,317, includes a collar defining an opening with an inner perimeter is provided with a pivotally mounted cover having an outer perimeter greater than the inner perimeter of the collar. A seal is provided to seal between the cover and the collar. Closure structure is provided to secure the free end of the cover to the collar. A threaded bolt is provided to close the cover. A pivotally mounted lever arm is mounted to the bolt for turning of the bolt. An adjustable threaded hinge is provided to adjust the cover in a longitudinal direction relative to the collar. The manhole cover apparatus is useable on pressure containers, such as those used to pneumatically handle particulate material.

U.S. Pat. No. 5,451,119, is a barrel-shaped manhole frame for receiving a manhole cover is provided with an inwardly directed peripheral flange at its lower end having circumferentially spaced, inclined grooves to receive wedges that can be driven into surrounding earthwork to wedge the frame upwardly and thereby adjust its height and slope to conform with a roadway or sidewall surface under construction.

Additionally, U.S. Pat. No. 5,470,172, is a molded plastic extension member for use in increasing the height of manholes, or catch basins when surfacing or resurfacing a roadway is described. A wedge to adjust the angle of the catch basin support frame or the manhole cover support frame is also described. The extension includes a pocket for reducing the total surface area of the molded plastic member. It also includes a shoulder that interlocks with either the manhole cone, the catch basin cone, or with other stackable molded plastic members. The extension also contains a planer support surface which provides rigidity and support, and provides a surface for caulking to be applied to form a watertight seal.

SUMMARY OF THE INVENTION

It has been recognized that it would be advantageous to develop an improved utility access or manhole top structure which is adjustable in height. In addition, it has been recognized that it would be advantageous to develop a utility access or manhole with both a variable cover height adjustment, and a variable angular adjustment, to allow the top of the cover to sit flush with the surrounding surface, such as a road. In addition, it has been recognized that it would be advantageous to develop a method for adjusting the height and angular orientation of a utility access.

The invention provides an adjustable utility access device with a height adjustment means for adjusting the height of a cover relative to a frame, and an angle adjustment means for adjusting the angle of the cover relative to the frame. Thus, the cover can be positioned flush with a surface, such as a roadway. The utility access can be a manhole.

The frame can be secured to a support surface over a utility, such as a manhole extension. The frame has an opening therethrough to provide access to the utility. The cover is removably disposed over the opening of the frame. The height adjustment means and the angle adjustment means can be disposed between the frame and the cover.

In accordance with one aspect of the present invention, the height adjustment means includes a first position that maintains the cover at a first height, and a different second position that maintains the cover at a different second height. In addition, the angle adjustment means includes a first position in which a top edge of the adaptor ring is parallel with a bottom edge of the frame, and a second position in which the top edge of the adaptor ring forms an angle with respect to the bottom edge of the frame greater than 0 degrees and less than 20 degrees.

In accordance with another aspect of the present invention, the angle adjustment means further comprises an adaptor ring rotatably disposed on the frame, and first and second angled edges formed between the adaptor ring and the frame. The frame can include the first angled edge, and the adaptor ring can include the second angled edge.

In accordance with another aspect of the present invention, the height adjustment means and the angle adjustment means further comprise the frame having a first angled edge. An adaptor ring can be rotatably disposed on the frame, and have a second angled edge rotatably engagable with the first angled edge of the frame. In addition, the adaptor ring can have a plurality of steps formed thereon. An extension ring can be selectively disposed on the adaptor ring, and have at least one tab attached thereto selectively engagable with at least one of the plurality of steps.

In accordance with another aspect of the present invention, the height adjustment means includes a plurality of pockets formed about a circumference of the opening, and have bottoms disposed at different elevations. At least one mating tab can selectively mate with at least one of the pockets to selectively position the tab at a desired elevation.

In accordance with another aspect of the present invention, the height adjustment means includes an adaptor ring disposed on the frame, and having a plurality of steps at different elevations formed about a circumference thereof. An extension ring can be disposed on the adaptor ring, and can have at least one tab selectively engagable with at least one of the plurality of steps to selectively elevate the extension with respect to the frame.

A method of using the adjustable utility access, or for adjusting the orientation and height of the cover locating the frame over the utility access; locating the cover over the opening of the frame; selectively rotating first and second angled edges to selectively orient the cover with respect to the frame; and selectively rotating at least one tab with respect to a plurality of steps to selectively adjust a height of the cover with respect to the frame.

In accordance with one aspect of the present invention, the step of selectively rotating the first and second angled edges further includes selectively rotating an adaptor ring with respect to the frame. The frame and adaptor ring have the respective first and second angled edges.

In accordance with another aspect of the present invention, the step of selectively rotating the adaptor ring further includes engaging the ground with a distal end of a lever arm; engaging a protrusion which extends from the adaptor ring with an intermediate section of the lever arm which is adjacent the distal end; and pivoting the lever arm about the distal end thereof by applying a force to a proximal end of the lever arm.

In accordance with another aspect of the present invention, the frame also can be selectively rotated by engaging the ground with a distal end of a lever arm;

engaging a protrusion which extends from the frame with an intermediate section of the lever arm which is adjacent the distal end; and pivoting the lever arm about the distal end thereof by applying a force to a proximal end of the lever arm. Thus, both the frame and adaptor ring can be selectively rotated to properly orient the cover.

In accordance with another aspect of the present invention, the step of selectively rotating first and second angled edges, and the step of selectively rotating the at least one tab with respect to the plurality of steps, further include selectively rotating an adaptor ring with respect to the frame, the frame and adaptor ring having the respective first and second angled edges; and selectively rotating an extension ring with respect to the adaptor ring, the adaptor ring having the plurality of steps formed thereon, and the extension ring having the at least one tab attached thereto to selectively engage at least one of the plurality of steps of the adaptor ring. The step of selectively rotating the adaptor ring further includes engaging the ground with a distal end of a lever arm; engaging a protrusion which extends from the adaptor ring with an intermediate section of the lever arm which is adjacent the distal end; and pivoting the lever arm about the distal end thereof by applying a force to a proximal end of the lever arm. Again, the frame can be selectively rotated by engaging the ground with a distal end of a lever arm; engaging a protrusion which extends from the frame with an intermediate section of the lever arm which is adjacent the distal end; and pivoting the lever arm about the distal end thereof by applying a force to a proximal end of the lever arm. Thus, both the frame and adaptor ring can be selectively rotated to properly orient the cover.

Additional features and advantages of the invention will be set forth in the detailed description which follows, taken in conjunction with the accompanying drawing, which together illustrate by way of example, the features of the invention.

DETAILED DESCRIPTION OF THE PREFERRED EMBODIMENT

Figure 1:
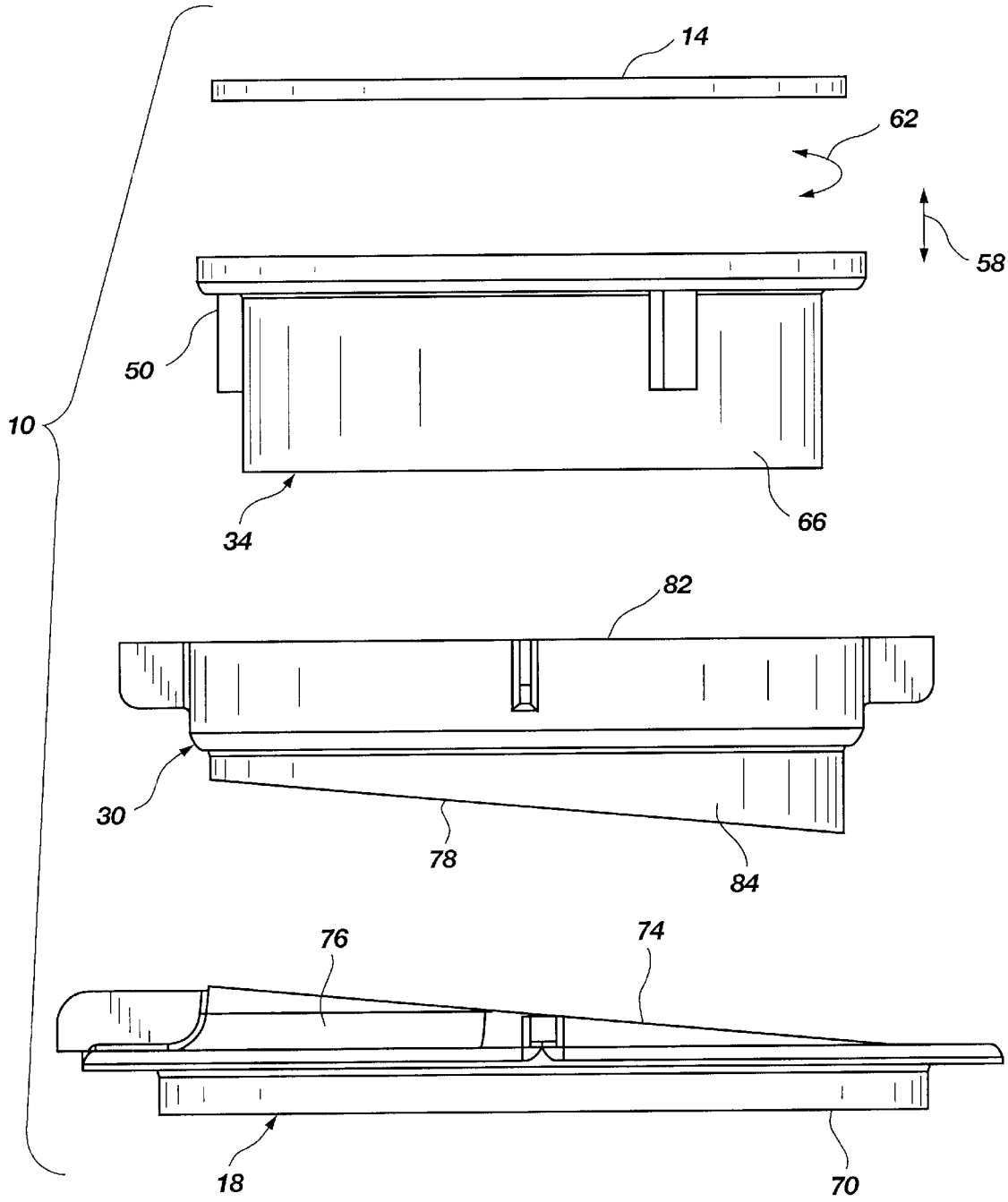
FIG. 1 is an exploded side view of a utility access device in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

As illustrated in FIG. 1, a height and angle adjustable utility access device, indicated generally at 10, in accordance with the present invention is shown for adjusting the height and angle of a cover 14 to be flush with a surface (not shown), such as a roadway. Manhole openings or manhole access is one example of a field which may benefit from use of such a device 10. Thus, the utility access device 10 is illustrated and described herein as being configured for use as a manhole for providing access to a utility beneath a roadway. It is of course understood that the utility access device 10 of the present invention can be configured for access to any structure, storage, or utility, including for example, water lines, water valves, water meters, gas lines, gas valves, cable lines and equipment, electrical lines and equipment, etc.

The utility access device 10 can include the cover 14 and a frame or manhole ring 18. The frame 18 has an opening 22 (FIG. 5) therethrough for providing access therethrough to a utility. The cover 14 covers the opening 22. The frame 18 can be disposed on or attached to a manhole extension (not shown) as is known in the art. The manhole extension is usually made of concrete and has a hole forming a vertical shaft for workmen to climb down for access to underground utilities, storage or structures. Typically, the frame 18 and manhole extension are located underneath a surface, such as a roadway, and the cover 14 should be flush with the surface or roadway.

The utility access device 10 advantageously includes a height adjustment mechanism or means for adjusting the height of the cover 14 with respect to the frame 18, and thus with respect to a surface or roadway. In addition, the utility access device 10 advantageously includes an angle adjustment means for adjusting the angle of the cover 14 relative to the frame 18, and thus with respect to a surface or roadway. Preferably, the utility access device 10 includes an adaptor or adaptor ring 30, and an extension or extension ring 34. The adaptor ring 30 is disposable on, and engages, the frame 18, while the extension ring 34 is disposed on, or received by the adaptor ring 30. The cover 14 is removably disposed on the extension ring 34, and thus is removably disposed over the opening 22 of the frame 18. Both the adaptor ring 30 and extension ring 34 can be annular or ring-like, and have access holes formed therethrough. It is of course understood, that the adaptor 30 and extension 34 can be of any shape.

Figure 7:
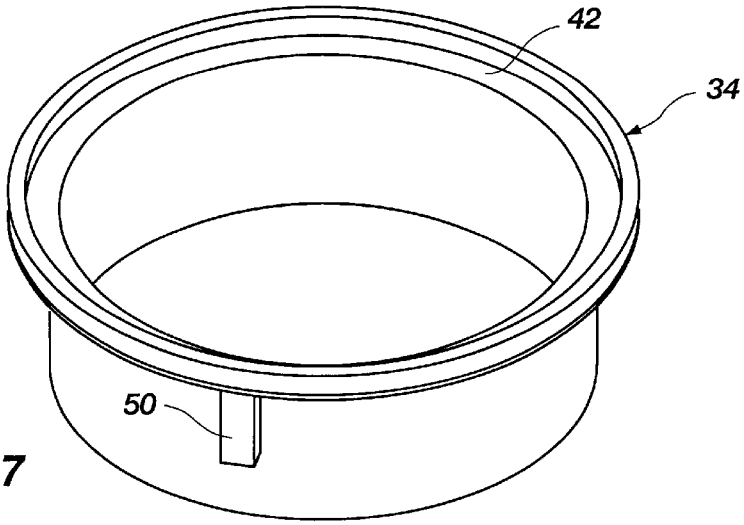
FIG. 7 is a perspective view of an extension ring of the utility access device of FIG. 1.

The cover 14 preferably is a standard cover. Thus, the extension ring 34 can have an opening 42 (FIG. 7) sized and shaped to receive the cover 14.

Figure 6:
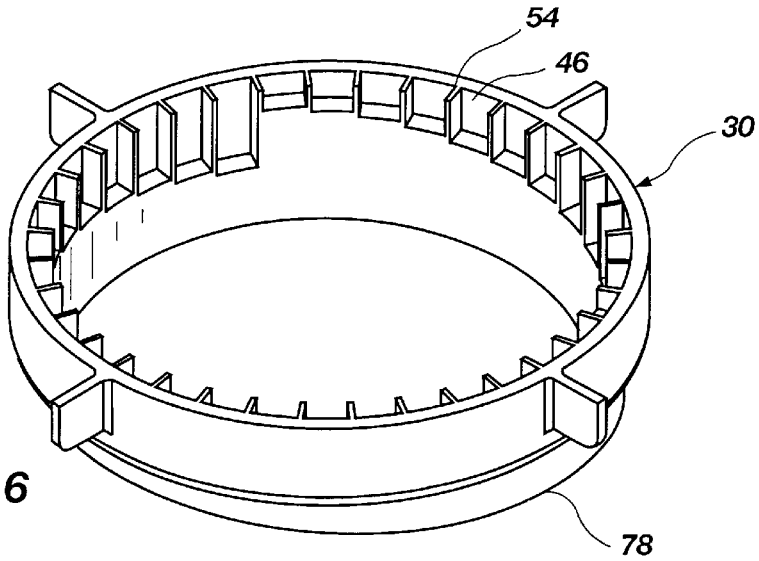
FIG. 6 is a perspective view of an adaptor ring of the utility access device of FIG. 1.

The adaptor ring 30 advantageously includes a plurality of steps or pockets 46, as shown in FIG. 6, while the extension ring 34 includes one or more mating tabs 50 which engage or selectively mate with the steps or pockets 46 to selectively position the tabs 50, and thus the extension ring 34 and cover 14, at a desired elevation. Referring to FIG. 6, the plurality of steps or pockets 46 can be formed in an inner surface or circumference of the adaptor ring 30, and are disposed at different elevations. The plurality of steps or pockets 46 preferably includes three sets of steps or pockets, each with a matching plurality of steps or pockets. It is believed that three sets of steps or pockets, and three tabs 50 (FIG. 1) provides the greatest stability between the adaptor ring 30 and extension ring 34 (FIG. 1), and greatest flexibility in tolerances. For example, it is believed that three tabs 50 (FIG. 1) can engage or rest on three steps 46 without wobbling, and without meeting exacting tolerances.

As discussed above, the plurality of steps or pockets 46 can be conceptualized in different ways. The adaptor ring 30 can have a plurality of steps arranged in a stair-like fashion around the interior of the adaptor ring 30, with each subsequent step being at a higher or lower elevation as the steps extend around the adaptor ring 30. The adaptor ring 30 also can have a plurality of pockets or indentations formed in the inner surface and upper edge of the adaptor ring 30. The pockets can have bottom walls at different elevations, or the pockets can have different depths from the upper edge. In addition, adjacent steps or pockets 46 can be separated by walls 54 which prevent the tabs 50 (FIG. 1) from inadvertently moving from one step to another. For example, a wall 54 can be formed between a step and a proximal lower step to prevent the tab 50 from sliding off the step to the lower step under an applied force and/or vibration.

Referring again to FIG. 1, the one or more tabs 50 can be formed on the extension ring 34. The tabs 50 can be formed on the exterior surface or outer circumference of the extension ring 34. As stated above, the extension ring 34 preferably has three tabs 50. The tabs 50 have a bottom surface which engages or rests on the steps 46 (FIG. 6). In addition, the tabs 50 can be sized and shaped to mate with the pockets 46 (FIG. 6).

Figure 2:
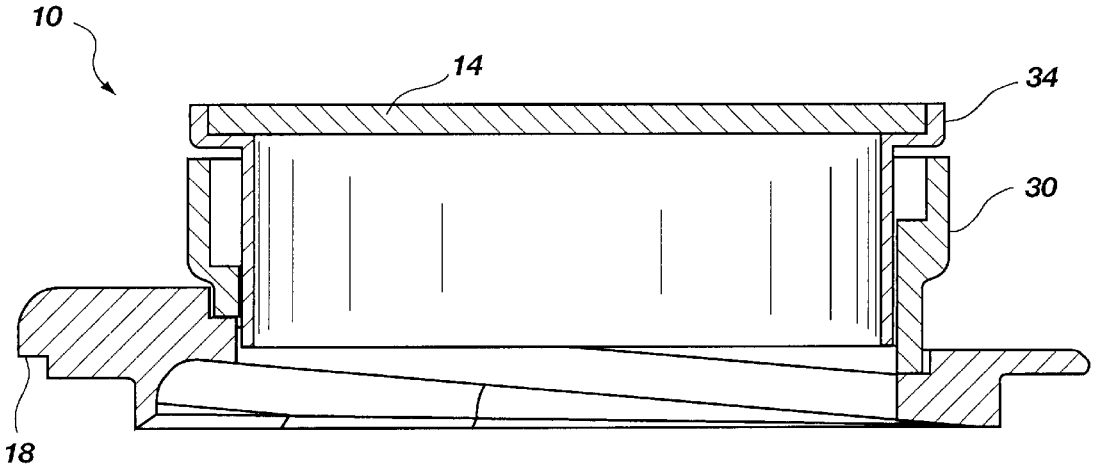
FIG. 2 is a cross sectional side view of the utility access device of FIG. 1, shown in a first lower position, and a first zero pitch orientation.
Figure 3:
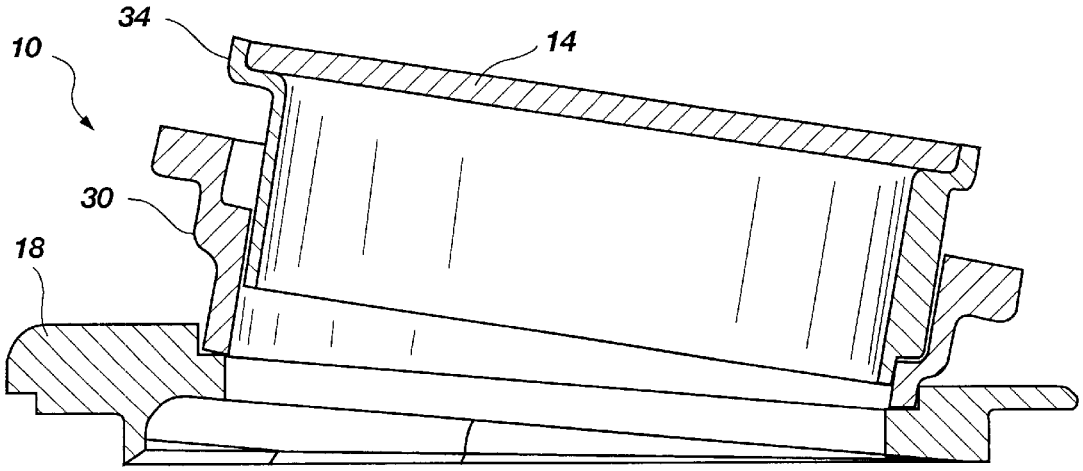
FIG. 3 is a cross sectional side view of the utility access device of FIG. 1, shown in a second higher position, and a second angled orientation.

The extension ring 34 can be vertically manipulated, indicated by arrow 58 (FIG. 1), with respect to the adaptor ring 30. For example, the extension ring 34 can be lifted vertically upwardly from the adaptor ring 30, and/or vertically placed on or in the adaptor ring 30. In addition, the extension ring 34 can be rotated, indicated by arrow 62, with respect to the adaptor ring 30. Thus, the extension ring 34 can be displaced vertically upwardly, and rotated, with respect to the adaptor ring 30 to position the extension ring 34 at a desired height with respect to the adaptor ring 30. For example, to increase the height, or elevate, the extension ring 34, the extension ring 34 is lifted and turned so that the tab 50 engages a higher step or pocket 46 (FIG. 6). With walls 54 extending to the top or upper edge of the adaptor ring 30, it may be necessary to completely remove the extension ring 34 from the adaptor ring 30 prior to rotation. Thus, the extension ring 34 can have a plurality of positions or rotational orientations with respect to the adaptor ring 30 which result in different heights or elevations of the extension ring 34. For example, the extension ring 34 can have a first position in which the tabs 50 rest on first steps or in first pockets 46 (FIG. 6) to maintain the cover 14 at a first height, as shown in FIG. 2, and at least a second position in which the tabs 50 rest on different second steps or in different second pockets at a different elevation to maintain the cover 14 at a different second height, as shown in FIG. 3.

The extension ring 34 can be sized and shaped to extend into the adaptor ring 30. The extension ring 34 can have a vertical skirt or extension 66 with a length or height sized to completely cover the steps or pockets when the extension ring 34 is received within the adaptor ring 30, thus preventing access from the interior to any cavities formed by the steps.

The adaptor ring 30 with steps 46 (FIG. 5) and the extension ring 34 with tabs 50 are one example of a height adjustment means for adjusting the height of the cover 14 relative to the frame 18. It is of course understood that other means can be used, including for example: exterior steps or pockets, and interior tabs; steps on the extension ring, and tabs on the adaptor ring; steps or tabs directly on the frame; a plurality of steps forming the tabs; various different numbers of sets of steps and/or tabs; steps on both the adaptor ring and the extension ring, etc.

As stated above, the utility access device 10 also advantageously includes an angle adjustment means or orientor to selectively orient the cover with respect to the frame. The frame 18 has a bottom edge 70 which can be disposed on a manhole extension, as is known in the art. The bottom edge 70 is commonly oriented horizontally, or perpendicular to vertical. Preferably, the frame 18 also has a top edge 74 which advantageously is angled with respect to the bottom edge 70. The frame 18 has a perimeter wall 76 which varies in height from a shorter end to an opposite higher end.

In addition, the adaptor ring 30 preferably has a bottom edge 78 which is angled with respect to a top edge 82. The adaptor ring 30 has a perimeter wall 84 which varies in height from a shorter end to an opposite higher end. The angled bottom edge 78 rotatably engages the angled top edge 74 of the frame 18. The angled edges 78 and 74 for the orientor. Thus, the angular orientation of the adaptor ring 30, or upper edge 82 thereof, can be selectively oriented with respect to the frame 18, or bottom edge thereof 70. For example, the adaptor ring 30 and frame 18 can have a first position in which the tope edge 82 of the adaptor ring 30 is parallel with the bottom edge 70 of the frame 18, such as by aligning the shorter end of the adaptor ring 30 with the higher end of the frame 18, as shown in FIG. 2. In addition, the adaptor ring 30 and frame 18 can have a second position in which the top edge 82 of the adaptor ring 30 forms an angle with respect to the bottom edge 70 of the frame 18, as shown in FIG. 3. Such an angle can be formed by selectively orienting or rotating the adaptor ring 30 with respect to the frame 18. It will be appreciated that a maximum angular orientation can be achieved by aligning the higher ends of the adaptor ring 30 and frame 18.

Preferably, the angled top edge 74 of the frame 18 forms an angle with respect to the bottom edge 70 greater than 0 degrees, and less than or equal to 10 degrees. Similarly, the angled bottom edge 78 of the adaptor ring 30 preferably forms an angle with respect to the top edge 82 greater than 0 degrees, and less than or equal to 10 degrees. Thus, the adaptor ring 30 and frame 18 can be oriented or rotated with respect to one another to vary the angle between the bottom and top edges 70 and 82 between 0 and twenty degrees.

Figure 4:
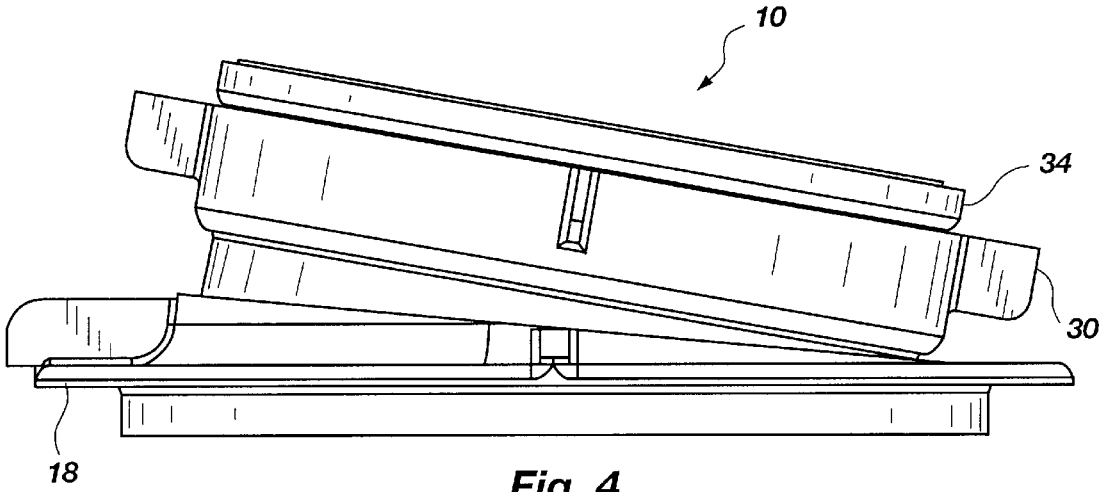
FIG. 4 is a side view of the utility access device of FIG. 1, shown in the first lower position, and the second angled orientation.
Figure 5:
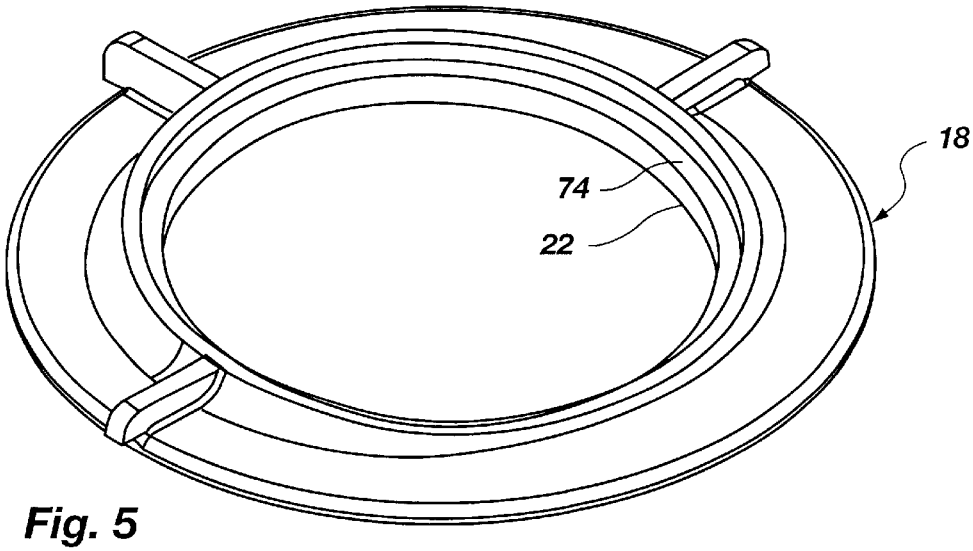
FIG. 5 is a perspective view of a frame of the utility access device of FIG. 1.

Referring to FIG. 4, the top edge 74 of the frame 18 can be configured to receive the bottom edge 78 (FIG. 5) of the adaptor ring 30 (FIG. 5). The top edge 74 can have a lip or flange upon which the bottom edge 78 (FIG. 5) abuts, and a perimeter wall surrounding the bottom edge 78 (FIG. 5). Thus, the adaptor ring 30 can rotate within the frame 18. It is of course understood that the mating structure can be reversed so that the top edge of the frame is received within the bottom edge of the adaptor ring.

The angled edges 74 and 78 between the adaptor ring 30 and frame 18, or between the frame 18 and cover 14, are one example of an angle adjustment means for adjusting the angle of the cover 14 relative to the frame 18. It is of course understood that other means can be used, including for example, different angled edges, etc. It also is understood that the locations of the height adjustment means and the angle adjustment means can be reversed.

In addition, the rings and frame can be permanently fixed to each other by means of bolts, or pegs, or other secure means of bonding after having been adjusted. In addition, the rings also could be made with appropriate hand-grips, or means of inserting external handles, to facilitate the workers in repositioning the height adjustment.

It is noted that the height adjustment means and angle adjustment means are illustrated to be positioned between the cover 14 and the frame 18. Both, however, can be placed below the frame 18, and above the manhole extension, and still achieve the same results.

It should be noted that most top manhole assemblies are of a fixed height and fixed angular orientation design. In a typical installation the manhole is located in a road for access to a sewer. When a subsequent layer of material is added to the surface, the manhole covers are no longer flush with the road surface. In one application of the present invention, the height or elevation of the cover 14 is increased, and the angular orientation adjusted. This provides a cost effective and efficient means of adjusting the height and angular orientation of manhole cover assemblies to match the surrounding surface. It is further noted that the frames and rings described above are designed to withstand the full weight of any passing vehicle or other live load. The frames and rings can be made out of cast iron or other strong material.

It is further noted that the above embodiments show the sets of steps making a transition from a high step to a low step. The transition, however, can be from the highest step to any intermediate step. Thus, a pyramid shaped stepping sequence could also be employed. This would allow rotation in either direction.

A method for using the adjustable utility access 10 described above, or for adjusting the orientation and the height of the cover 14, includes the steps of locating the frame 18 with its opening 22 over the utility access; locating the cover 14 over the opening 22 of the frame; selectively rotating the first and second angled edges 74 and 78 to selectively orient the cover 14 with respect to the frame 18; and selectively rotating the tab 50 with respect to the plurality of steps 46 to selectively adjust the height of the cover 14 with respect to the frame 18.

Figure 8:
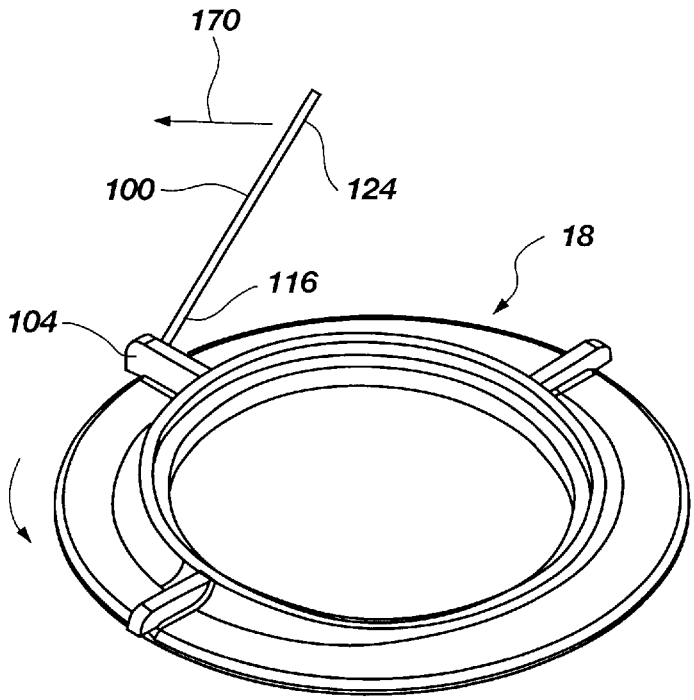
FIG. 8 is a perspective view of the frame of FIG. 5 showing a method for rotating the frame in accordance with the present invention.
Figure 9:
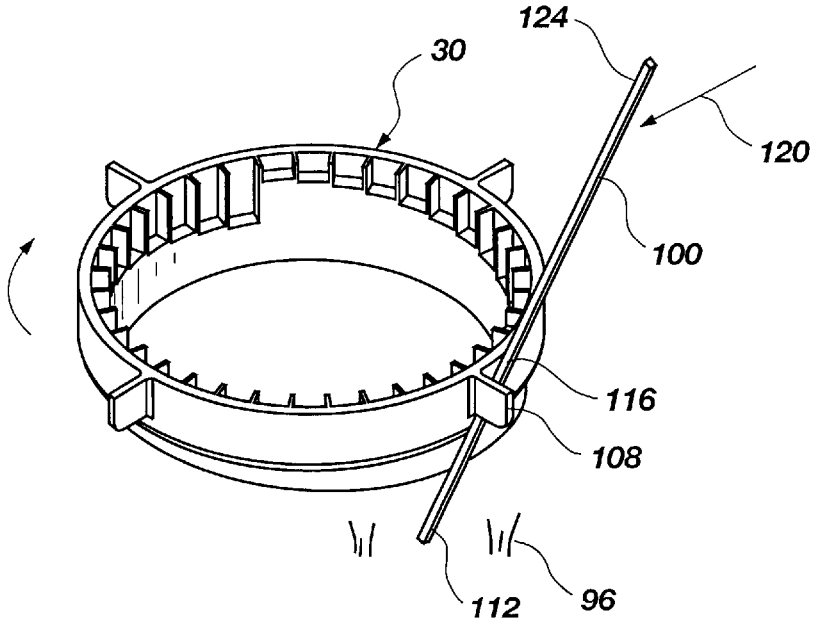
FIG. 9 is a perspective view of the adaptor ring of FIG. 6 showing a method for rotating the adaptor ring in accordance with the present invention.

The step of selectively rotating the first and second angled edges 74 and 78 can further include selectively rotating the adaptor ring 30 with respect to the frame 18. Referring to FIGS. 8 and 9, the frame 18 and adaptor ring 30 advantageously can be rotated with respect to one another or the ground 96 using a lever arm 100 and protrusions form on, and extending from, the frame and adaptor ring. The frame can have one or more protrusions 104 extending therefrom in a radial direction, and extending beyond the circumference or perimeter of the frame 18.

Similarly, the adaptor ring 30 can have one or more protrusions 108. The lever arm 100 can be used to engage the protrusions 104 or 108 to pivot the respective frame 18 or adaptor ring 30.

Referring to FIG. 9, the step of selectively rotating the adaptor ring can further include engaging the ground 96 with a distal end 112 of the lever arm 100. The protrusion 108 can be engaged by an intermediate portion 116 of the lever arm 100. The intermediate portion 116 is adjacent the distal end 112. Force, indicated by arrow 120, can be applied to a proximal end 124 of the lever arm 100 to pivot the lever arm 100 about the distal end 112, thus causing the intermediate portion 116 to move against the protrusion 108 and rotate the adaptor ring 30. Thus, the adaptor ring 30 can be pivoted with respect to the frame 18 to pivot the first and second angled edges 74 and 78 and adjust the angle of the upper end of the adaptor ring 30, and thus the cover 14.

Similarly, the frame 18 can be pivoted or rotated to further orient the angle of the cover 14. Referring to FIG. 8, the lever arm 100 can engage the ground 96 with its distal end 112, and engage the protrusion 104 with its intermediate portion 116. Force 120 can be applied to the proximal end 124 of the lever arm 100 to pivot the lever arm 100 about its distal end 112 causing the intermediate section 116 to move against the protrusion 104 and rotate the frame 18. Thus, the frame 18 can be pivoted or rotated to orient the angle of the cover 14.

It will be appreciated that the frame 18 and the adaptor ring 30 can have significant weight, and thus be difficult to pivot or rotate by hand. In addition, it will be appreciated that the frame 18 and the adaptor ring 30 are located near ground level, making it difficult for workers to squat and turn. Thus, the lever arm 100 and protrusions 104 and 108 advantageously provide a method for pivoting or rotating the frame 18 and adaptor ring 30. In addition, the protrusions 104 and 108 can act as anchors to resist further movement as concrete or asphalt us poured about the frame and adaptor ring.

Furthermore, the step of selectively rotating the at least one tab with respect to the plurality of steps can further include selectively rotating the extension ring 34 with respect to the adaptor ring 30. The extension ring 34 may need to be lifted before it is rotated due to the walls 54.

Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function, manner of operation, assembly, and use may be made without departing from the principles and concepts set forth herein.

What is claimed is:

1. A height and angle adjustable utility access device, comprising:

a) a frame, configured to be secured over a utility, having an opening therethrough and a horizontally oriented flange;

b) a cover, removably disposed over the opening of the frame;

c) height adjustment means, disposed between the frame and the cover, for adjusting the height of the cover relative to the frame;

d) angle adjustment means, disposed between the frame and the cover, for adjusting the angle of the cover relative to the frame; and e) at least one projection, attached to the horizontally oriented flange and extending outwardly from the frame and past a perimeter of the horizontally oriented flange, configured to facilitate selective orientation of the frame during installation while resisting movement of the frame after installation.

2. A device in accordance with claim 1, wherein the height adjustment means includes:

a) a first position that maintains the cover at a first height; and b) a different second position that maintains the cover at a different second height; and wherein the angle adjustment means includes:

a) a first position in which the cover is parallel with a bottom edge of the frame; and b) a second position in which the cover forms an angle with respect to the bottom edge of the frame greater than 0 degrees and less than 20 degrees.

3. A device in accordance with claim 1, wherein the angle adjustment means further comprises:

a) an adaptor ring, rotatably disposed on the frame; and b) first and second angled edges formed between the adaptor ring and frame, with the frame including the first angled edge, and the adaptor ring including the second angled edge, to selectively orient a top edge of the adaptor ring with a bottom edge of the frame.

4. A device in accordance with claim 3, further comprising:

at least one projection, extending outwardly from the adaptor ring and past a perimeter thereof, configured to facilitate selective orientation of the adaptor ring during installation while resisting movement of the adaptor ring after installation.

5. A device in accordance with claim 1, wherein the height adjustment means and the angle adjustment means further comprise:

a) the frame having a first angled edge;

b) an adaptor ring, rotatably disposed on the frame, having a second angled edge rotatably engagable with the first angled edge of the frame, and having a plurality of steps formed thereon; and c) an extension ring, selectively disposed on the adaptor ring, having at least one tab attached thereto and selectively engagable with at least one of the plurality of steps.

6. A device in accordance with claim 1, wherein the height adjustment means includes:

a) a plurality of pockets, formed about a circumference of the opening, having bottoms disposed at different elevations; and b) at least one mating tab, selectively mating with at least one of the pockets, to selectively position the tab at a desired elevation.

7. A device in accordance with claim 1, wherein the height adjustment means includes:

a) an adaptor ring, disposed on the frame, having a plurality of steps at different elevations formed about a circumference thereof; and b) an extension ring, disposed on the adaptor ring, having at least one tab selectively engagable with at least one of the plurality of steps to selectively elevate the extension with respect to the frame.

8. A device in accordance with claim 1, wherein the utility access is a manhole; and wherein the frame is configured to be attached to a manhole extension.

9. A height and angle adjustable utility access device, comprising:

a) a frame, configured to be secured over a utility, having an opening therethrough and an angled upper edge;

b) a cover, removably disposed over the opening;

c) an adaptor ring, rotatably disposed on the frame, having an angled lower edge rotatably engagable with the angled upper edge of the frame;

d) a plurality of steps formed on the adaptor ring;

e) an extension ring, selectively disposed on the adaptor ring;

f) at least one tab, attached to the extension ring and selectively engagable with at least one of the plurality of steps; and g) a skirt extendable into the adaptor ring and having a length sized to extend to at least a lowest step in the adaptor ring when the extension ring is disposed on the adaptor ring.

10. A device in accordance with claim 9, wherein the plurality of steps are formed in an inner surface of the adaptor ring; and wherein the at least one tab is formed on an outer surface of the extension ring.

11. A device in accordance with claim 9, wherein the angled upper edge of the frame and the angled lower edge of the adaptor ring are rotatable between 1) a first position in which the cover is parallel with a bottom edge of the frame, and 2) a second position in which the cover forms an angle with respect to the bottom edge of the frame greater than 0 degrees and less than 20 degrees.

12. A device in accordance with claim 10, further comprising:

at least one projection, extending outwardly from the orientor and past a perimeter thereof, configured to facilitate selective orientation of the orientor during installation while resisting movement of the orientor after installation.

13. A device in accordance with claim 10, wherein the utility access is a manhole; and wherein the frame is configured to be attached to a manhole extension.

14. A device in accordance with claim 10, wherein each of the plurality of steps includes a wall disposed between a proximal lower step to prevent the at least one tab from inadvertently moving to the proximal lower step.

15. A device in accordance with claim 10, wherein the plurality of steps are formed by a plurality of pockets formed about a circumference of the opening having bottoms disposed at different elevations.

16. A device in accordance with claim 10, further comprising:

at least one projection, extending outwardly from the frame and past a perimeter thereof, configured to facilitate selective orientation of the frame during installation while resisting movement of the frame after installation.

* * * * *